US007293833B2

(12) United States Patent
Takeuchi et al.

(10) Patent No.: US 7,293,833 B2
(45) Date of Patent: Nov. 13, 2007

(54) CHAIR AND SUPPORT MECHANISM UNIT THEREOF

(75) Inventors: Hiroshi Takeuchi, Osaka (JP); Hiroto Ogata, Osaka (JP)

(73) Assignee: Itoki Corporation, Osaka (JP)

( * ) Notice: Subject to any disclaimer, the term of this patent is extended or adjusted under 35 U.S.C. 154(b) by 0 days.

(21) Appl. No.: 11/345,630

(22) Filed: Feb. 2, 2006

(65) Prior Publication Data

US 2006/0181128 A1 Aug. 17, 2006

(30) Foreign Application Priority Data

Feb. 2, 2005 (JP) ..... 2005-026148
Nov. 29, 2005 (JP) ..... 2005-344243

(51) Int. Cl.
*A47C 1/024* (2006.01)

(52) U.S. Cl. ..... 297/301.4; 297/303.5

(58) Field of Classification Search ..... 297/301.1, 297/301.2, 301.4, 303.5, 440.21
See application file for complete search history.

(56) References Cited

U.S. PATENT DOCUMENTS 1,336,510 A * 4/1920 Collier ..... 297/301.4
2,859,799 A * 11/1958 Moore ..... 297/300.5
4,232,900 A * 11/1980 Parker ..... 297/300.5
4,240,663 A * 12/1980 Locher ..... 297/239
4,533,177 A * 8/1985 Latone ..... 297/303.5
4,589,697 A * 5/1986 Bauer et al. ..... 297/301.2
5,069,496 A * 12/1991 Kunh et al. ..... 297/301.2
5,447,357 A * 9/1995 Dauphin ..... 297/301.4
6,039,397 A * 3/2000 Ginat ..... 297/289
6,149,236 A * 11/2000 Brauning ..... 297/301.2
6,874,853 B2 * 4/2005 Wild ..... 297/300.2

FOREIGN PATENT DOCUMENTS

JP 48-37430 11/1973
JP 48-40818 11/1973
JP 2003-159150 6/2003
JP 2005-211467 8/2005

* cited by examiner

*Primary Examiner*—Peter R. Brown
(74) *Attorney, Agent, or Firm*—Whitham, Curtis, Christofferson & Cook, PC

(57) ABSTRACT

A chair is provided with a base 6 fixed at an upper end of a leg pillar 5, a back support unit 13 attached to the base 6 so as to tilt backward, a backrest 3 attached to the back support unit 13, and a spring unit 14 supporting the backward tilt of the back support unit 13. The spring unit 14 is to expand and contract in a back and forth direction when viewed from above and arranged further behind than a tilt supporting point 16*a* of the back support unit 13. The back support unit 13, the spring unit 14, and the base 6 constitute a kind of link mechanism and the spring unit 14 will expand and contract mainly at the front end, while tilting backward.

10 Claims, 13 Drawing Sheets

CHAIR AND SUPPORT MECHANISM UNIT THEREOF

BACKGROUND OF THE INVENTION

1. Field of the Invention

The present invention relates to a chair (rocking chair) provided with a backrest which tilts backward and a support mechanism unit which is used thereof.

2. Description of the Related Art

In a rocking chair, whose backrest tilts backward, a spring means is used to support the backward tilt of the backrest. The spring means includes a compression coil spring, blade spring, torsion bar, rubber, gas cylinder (or gas spring) and the like, and in general, a compression coil spring is commonly used. The compression coil spring is in most cases arranged in a box-shaped base opened upward in a posture extending approximately in a back and forth direction, when viewed from above.

Further, the coil spring is supported by front and rear spring bearings, and a space between these front and rear spring bearings adjusts an initial elastic force (hardness) of the coil spring. The initial elastic force of the coil spring often makes use of an adjustment mechanism by the use of a wedge member to change a position of either the front spring bearing or the rear spring bearing. A handle for operating the wedge member (it may be called a knob or grip) is often arranged on a lower surface site of the base.

In addition, the backrest is often attached to a back support unit attached to the base so as to tilt backward, and in general a compression coil spring is contracted or deformed by the backward tilt of the back support unit.

A rocking mechanism in which the above-described compression coil spring is used has been disclosed by Japanese Published Examined Patent Application No. Sho-48-37430 and Japanese Published Examined Utility Model Application No. Sho-48-40818. More specifically, the rocking mechanism is constructed in such a way that a projecting portion projecting behind a seat is provided on a base, a back support unit is attached to the projecting portion by using pins so as to tilt backward, a cylinder opened backward in a forward tilting posture when viewed from the side is fixed to the base, a compression coil spring and an adjusting member for pushing the coil spring are fitted inside the cylinder, by which a load resulting from the backward tilt of the back support unit is allowed to act on the compression coil spring from behind via the adjusting member.

In the chair disclosed by the above two publications and many other chairs, since a pressing force is allowed to act upon a compression coil spring at a site further forward than a tilt supporting point (turnable supporting point) of a back support unit, the compression coil spring undergoes a great load due to the leverage, while at the same time, the compression coil spring is restricted in length due to a limited space inside the base. Therefore, conventionally, a compression coil spring is made with a thick wire to secure a necessary repulsive force (elastic restoring force), even if the coil spring is short in length.

On the other hand, it is known that where a seated person reclines against a backrest to assume a rocking posture, he or she may have a sense of discomfort due to the impact, upon an abrupt backward tilt of the backrest, however, where the backrest tilts backward slowly all the way to the backward tilt limit, he or she does not have a sense of discomfort but feels comfortable. Further, when a seated person sits up from a rocking motion, it is preferable that a backrest moves accordingly and slowly.

However, where the spring is kept in a certain posture as disclosed in the publications, a problem occurs when either a backrest abruptly tilts backward for a very short time when a seated person reclines against the backrest, or only a slight backward tilt does not produce a backward tilt due to an abruptly increased repulsive force of a spring, thereby making it impossible to provide a comfortable rocking motion.

This point may be solved by increasing an initial elastic force of a compression coil spring. However, a greater initial elastic force of the compression coil spring only results in a difficulty in backward tilt, and no comfort is, therefore, expected when a greater initial elastic force is imparted to the compression coil spring.

Further, if a maximum backward tilt angle of a backrest is made greater, a comfortable rocking motion can be obtained. However, there has been a problem in that a conventional spring is restricted in length and a backward tilt angle of the backrest is restricted accordingly, making it difficult to increase a backward tilt angle of the backrest. In addition, another problem occurs where a handle for adjusting an initial elastic force of a spring is arranged on a lower surface of a base, a person has to operate the handle in a bent posture, therefore, making the adjusting operation more troublesome.

On the other hand, various structures are adopted in a backrest of a chair. In a revolving chair commonly used in an office (a chair whose seat is supported by a leg pillar so as to rotate horizontally), a backrest is in most cases structured with three layers, namely, a resin-made outer shell functioning as a reinforcing member, a resin-made inner shell functioning to support the body and a cushion layer applied on a front surface of the inner shell, and the outer shell is often fixed to the back support unit by using screws.

The conventional three-layer structured backrest is advantageous in excellent cushioning characteristics. However, there is one problem that workability is not always good in assembling of chairs. More specifically, in a chair whose backrest has a conventional three-layered structure, a cushion is in general attached to an inner shell in advance, and after attachment of an outer shell to a back support unit, the inner shell is attached to the outer shell. It may take more time and labor to assemble the chair, because the attachment of the outer shell to the back support unit and the attachment of the inner shell to the outer shell must be performed.

In a case of assembly by a knock-down method where several unitized members are assembled, it is desirable that assembly processes should be reduced as much as possible in view of workability and stable quality. It is, therefore, required to reduce the number of components as much as possible, for which a conventional backrest structure will not satisfy the requirement.

There is also a problem related to the conventional three-layer structured backrest that only an outer shell does not function as a backrest and always needs a cushion-equipped inner shell, which makes it difficult to simplify the structure. In other words, a conventional outer shell is in general provided with many ribs formed on the front surface for reinforcement. Therefore, a person is not allowed to recline against the outer shell, thus making it impossible to simplify the structure of the backrest.

SUMMARY OF THE INVENTION

The present invention has been made in view of the problems and the object thereof is to improve the above-described situation.

The chair of the present invention is provided as fundamental components with a seat, a base supporting the seat from below, a backrest attached to the base via a back support unit so as to tilt backward, and a spring means supporting elastically the backward tilt of the back support unit and the backrest.

Then, the spring means expands and contracts in a back and forth direction when viewed from above, the spring means is supported from forward by the base and a load resulting from the backward tilt of the backrest also acts on the spring means approximately from rearward, a rear end portion of the spring means is situated further rearward than a tilt supporting point of the back support unit, a front end portion of the spring means is situated further below than a tilt supporting point of the back support unit, and the spring means is also allowed to tilt together with the backrest and the back support unit centering around a support portion in relation to the base.

In the present invention, since a site further behind the tilt supporting point of the back support unit is supported by a spring means, a load point which acts on the spring means is made distant from the tilt supporting point of the back support unit, thereby making it possible to reduce a load acting on the spring means, as compared with a conventional one which deforms a spring means by leverage.

Further, since the spring means is arranged so as to extend rearward of the base, a space for installing the spring means is not restricted by the base. As a result, the spring means is made longer in length and allowed to expand or contract to a greater extent in association with backward tilt of the backrest.

As described so far, alleviation of load on a spring means is combined with a greater expansion and contraction of the spring means, thereby making it possible to support continuously and accurately the backward tilt of the backrest in all the ranges (namely, the backrest is prevented from tilting backward abruptly or being stopped in the course of the backward tilt) and provide a comfortable rocking motion.

Further, since the spring means is allowed to expand and contract to a greater extent, the backrest has a greater backward tilt angle than those in the related art, therefore making it possible to provide a greater comfort in the rocking state.

In a preferable mode of the present invention, a back support unit and a backrest are manufactured separately. Then, a plurality of pillar portions extending approximately upward are arranged at the right and left at a rear portion of the back support unit with a predetermined space when viewed from the front. At the same time, a fixing portion having a fixing hole opened downward and fitted from above into the pillar portion is formed at the backrest. The above-described construction allows the backrest to be attached to the back support unit by a simple and quick action, thereby contributing to a better workability in assembly of chairs.

Further, in a preferable mode of the invention, the backrest is provided with a synthetic resin-made main member in which a portion supporting the body of a seated person is continuously and integrally formed with a portion attached to the back support unit, and the main member extends downward below a seat surface to form a fixing portion which fits from above into a pillar portion of the back support unit. The above-described construction makes the backrest simple in structure. In this instance, a smooth profile is given to the front surface of a main member, thereby making it possible for a user to recline against the main member directly and also contributing to a simple structure of the backrest (as a matter of course, a cushion may be applied in front of the main member).

Further, in a preferable mode of the present invention, the back support unit is provided with a first frame which extends in a back and forth direction in a state that the front end portion is attached to the base and a second frame made with a metal bar or a metal pipe and projects on both the right and the left sides behind the first frame. The right and left second frames are provided with an inclined portion which falls on the right and left outside when viewed from the front and an upward pillar portion mounted at a front end of the inclined portion, a fixing portion of the backrest is fitted into the pillar portion from above. At the same time, a recessed groove which fits from above into an inclined portion of the second frame in the back support unit is formed on a main member of the backrest. The above-described construction imparts a better supporting strength to the backrest, because the second frame of the back support unit is fitted into the backrest both at the inclined portion and at the pillar portion.

Where a backrest is provided with a synthetic resin-made main member, it is preferable to attach a synthetic resin-made pin-shaped buffer extending upward from an upper end of the pillar portion at the pillar portion of the back support unit, thereby, preventing stress from concentrating on a specific site at a fixing portion of a main member to improve the durability. It is noted that the buffer also constitutes the pillar portion.

Still further in a preferable mode of the present invention, a catch portion which is forcibly fitted into a root of the second frame in the back support unit from above or from behind is formed at a main member of the backrest. Since the catch portion is provided to prevent the main member from being removed from above, the backrest is securely attached to the back support unit by a simple and quick action.

In a preferable mode of the present invention, the spring means is a compression coil spring which is assembled into a spring unit. The spring unit is provided with spring bearings arranged front and rear of the compression coil spring, a screw-type adjusting rod for adjusting a space between the front spring bearing and the rear spring bearing and an operation handle for rotating operating the adjusting rod, and the operation handle is arranged at a rear end of the spring unit. Since the operation handle is arranged as described above, a user is able to operate the operation handle in a natural posture, without bending down for each action, thereby easily adjusting an initial elastic force of the compression coil spring.

In another preferable mode of the present invention, a hole for allowing the operation handle to attach to or detach from the adjusting rod is formed in a main member of the backrest. Since the above-described construction allows the adjusting rod or the operation handle to function as a stopper to block an upward motion of a backrest, in a chair which is easily assembled by fitting a backrest into a back support unit, the backrest is prevented from being removed from the back support unit even in an accidental case where a fitting of a main member of the backrest into the back support unit is cancelled (namely, the safety function is secured, while ease of assembly is kept).

In a preferable mode of the present invention, the operation handle is provided with a boss portion fitted into the adjusting rod so as not to relatively rotate and an oval-shaped grip portion integrally formed at the rear end of the boss portion. When a grip portion is formed in an oval shape, a person is able to rotate and operate the grip portion easily.

The present invention also includes a support mechanism unit of a chair. More specifically, the support mechanism unit is provided as fundamental components with a base which supports a seat from below, a back support unit which is attached to the base so as to tilt backward for attaching a backrest and a spring means which elastically supports the backward tilt of the back support unit.

Then, the spring unit is provided with a compression coil spring arranged in a posture extending in a back and forth direction when viewed from above and in a backward tilted posture when viewed from the side, a front spring bearing for receiving the compression coil spring from the front, a rear spring bearing for receiving the compression coil spring from behind, and a screw-type adjusting rod for adjusting a space between the front spring bearing and the rear spring bearing, the adjusting rod extends coaxially with the axis of the compression coil spring and the rear end of the adjusting rod is exposed behind the rear spring bearing, and an operation handle is attached to the exposed portion.

Further, a turnable supporting point of the back support unit is located further upward and forward than a front end of the spring unit, a support portion of the rear spring bearing is formed at the rear portion of the back support unit, a front end portion of the spring unit is supported by the base in a non-fixed manner so that the spring unit is allowed to tilt backward together with the back support unit, a stopper which restricts an upward turn position of the back support unit is also fixed to the base, and an initial elastic force is imparted to the compression coil spring in a state that the back support unit is held by the stopper so as not to turn upward.

Since the base, the back support unit and the spring unit are formed integrally in the support mechanism unit of the present invention, it is advantageous in conducting an efficient assembly of the chair. The advantage is particularly brought about when chairs are assembled by a knock-down method.

Here, in the present invention, an expression, "back and forth," is used to specify the construction. In this instance, the expression is used on the basis of a person who is seated in such a way that he or she reclines against a backrest.

BRIEF DESCRIPTION OF THE PREFERRED EMBODIMENTS

Figure 11A:
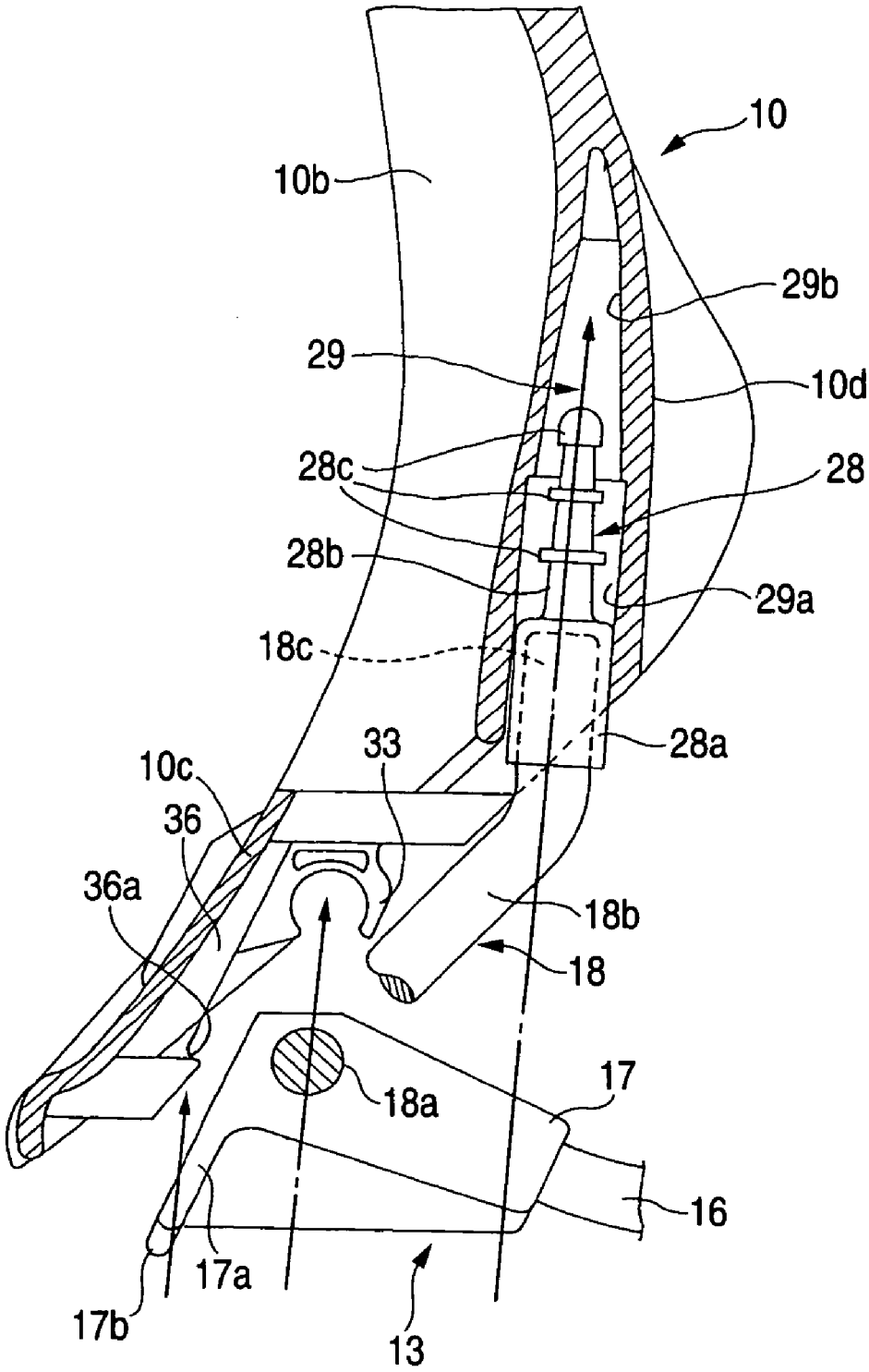
FIG. 11A is a cross-sectional view illustrating a state in the middle of backrest attachment process in a view indicated by the arrow XIA-XIA in FIG. 7.
Figure 11B:
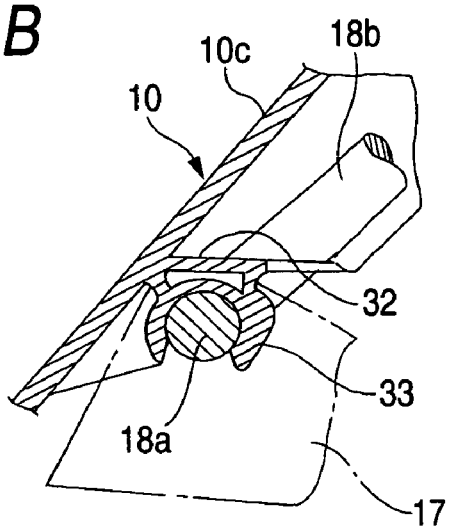
FIG. 11B is a cross-sectional view indicated by the arrow XIB-XIB in FIG. 8, illustrating a state that the backrest is attached.
Figure 11C:
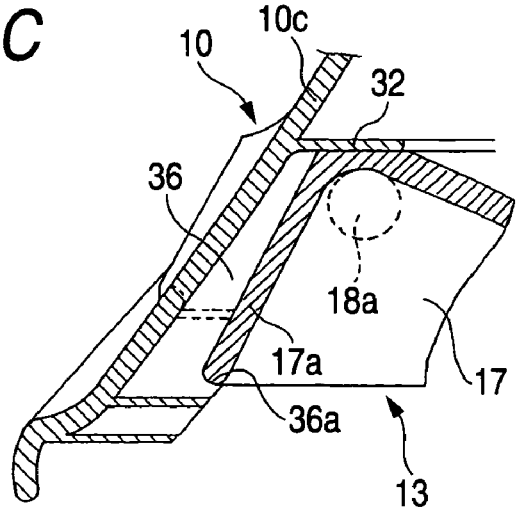
FIG. 11C is a cross-sectional view indicated by the arrow XIC-XIC in FIG. 8, illustrating a state that the backrest is attached.
Figure 11D:
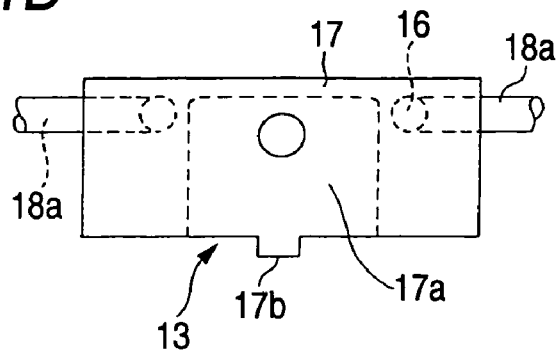
FIG. 11D is a rear view of the back receiving unit.
Figure 12:
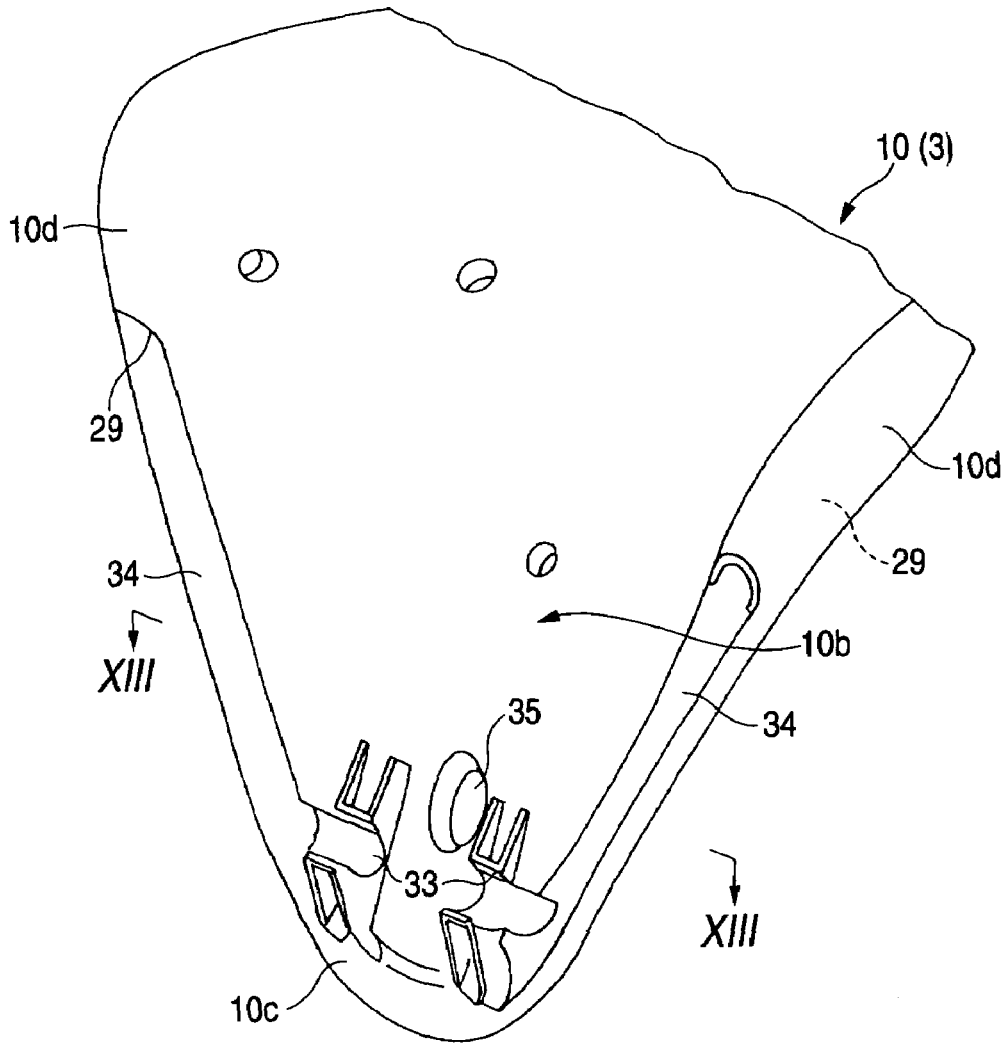
FIG. 12 is a perspective view of a second embodiment.
Figure 13:
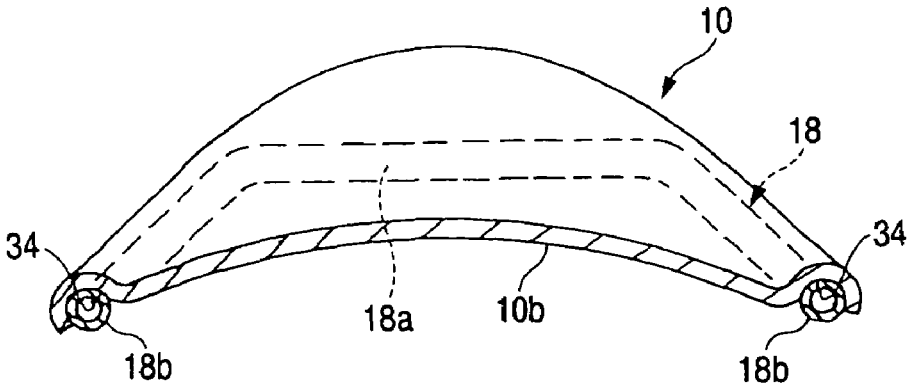
FIG. 13 is a cross-sectional view indicated by the arrow XIII-XIII in FIG. 12.

Next, an explanation will be made for embodiments of the present invention by referring to the figures. The present embodiment is applied to a revolving chair commonly used in an office. FIG. 1 through FIG. 11 illustrate a first embodiment and FIG. 12 through FIG. 13 illustrate a second embodiment.

(1) Outline of a First Embodiment

First, an explanation will be made for the outline of the first embodiment by referring to FIG. 1 through FIG. 5. The chair is provided with a leg 1, a seat 2, a backrest 3 and an armrest device 4 (the armrest device 4 is available in a pair of right and left armrest devices but only one of them is illustrated in the figure). The leg 1 is provided with a leg pillar 5 including a gas cylinder and a plurality of branch legs 1*a* (5 branch legs) extending in a radial manner. A caster 1*b* is provided at each front end of the branch legs 1*a*.

A base 6 opened upward is attached at an upper end of the leg pillar 5, a seat-receiving outer shell 7 is attached at an upper surface of the base 6, and the seat 2 is attached to the seat-receiving outer shell 7. A lock operation lever 8 for switching a state where the backrest 3 is allowed to tilt backward to a state where it is not allowed to tilt backward is exposed from the left side surface of the base 6. Further, a lifting lever 9 for adjusting the height of the seat 2 is exposed in front of the base 6. The lifting lever 9 extends long in a right and left direction along the lower surface of the front portion of the seat 2.

The backrest 3 is provided with a synthetic resin-made main member 10 (it may be called an outer shell). The main member 10 constitutes a large portion of the backrest 3, and a contour of the main member 10 is given a contour of the backrest 3. Both the front and rear surfaces of the main member 10 are smoothly formed. Then, the main member 10 is formed in such a way that a backrest portion 10*a* for supporting the back of a seated person and a waist rest portion 10*b* for supporting the abdomen of the seated person continue in a vertical direction. The main member 10 is also provided with a lower portion 10*c* extending further downward than the seat 2, and the lower portion 10*c* controls the attachment function. As illustrated in FIG. 2B, the lower portion 10*c* of the main member 10 is formed in a gabled shape which is a reversed convex and rounded when viewed from the front. An upper cushion 11 is attached to the backrest portion 10*a* and a lower cushion 12 is attached to the front surface of the waist rest portion 10*b*.

For example, as illustrated in FIG. 2B the backrest portion 10*a* of the backrest 3 is formed in an approximately reversed trapezoid in which the upper portion is the widest and the width is reduced directed downward, whereas both the right and left side surfaces of the waist rest portion 10*b* are formed in an arc shape which is an outward convex when viewed from the front. For this reason, a border between the backrest portion 10*a* and the waist rest portion 10*b* is given a profile which is smoothly curved and constricted, when viewed from the front.

Figure 1:
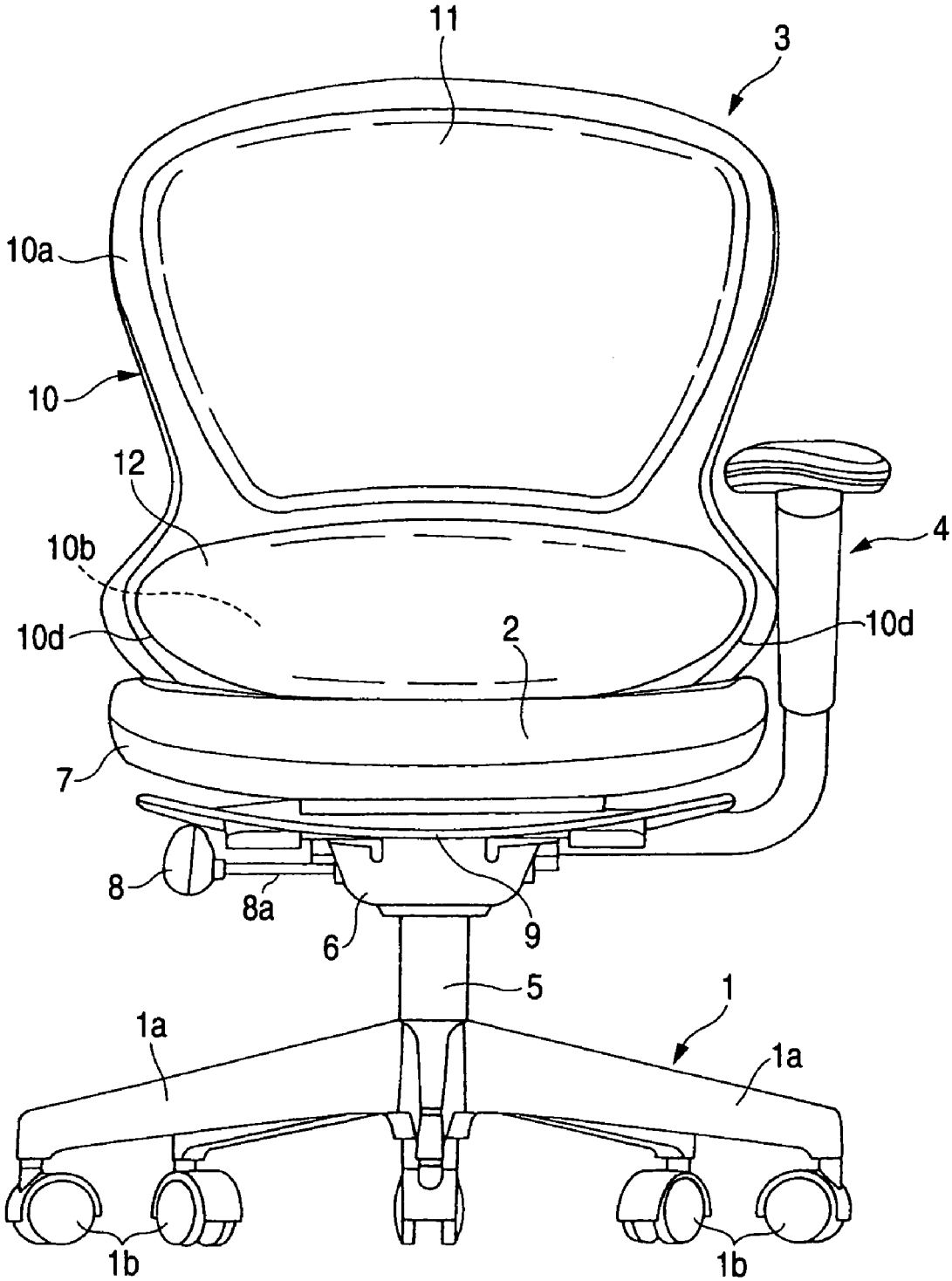
FIG. 1 is a front view illustrating a chair of a first embodiment of the present invention.
Figure 2A:
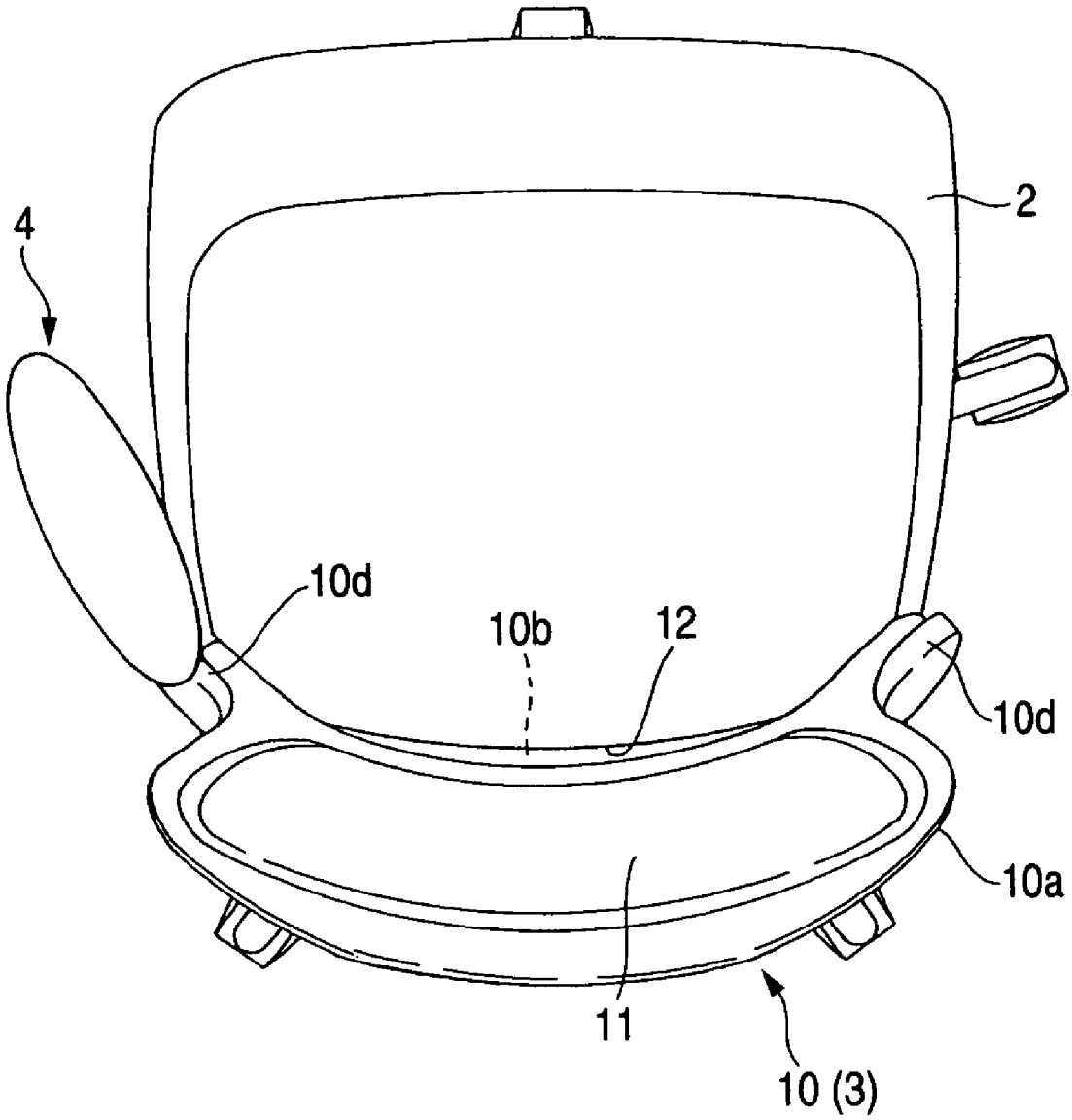
FIG. 2A is a plan view of the chair.
Figure 2B:
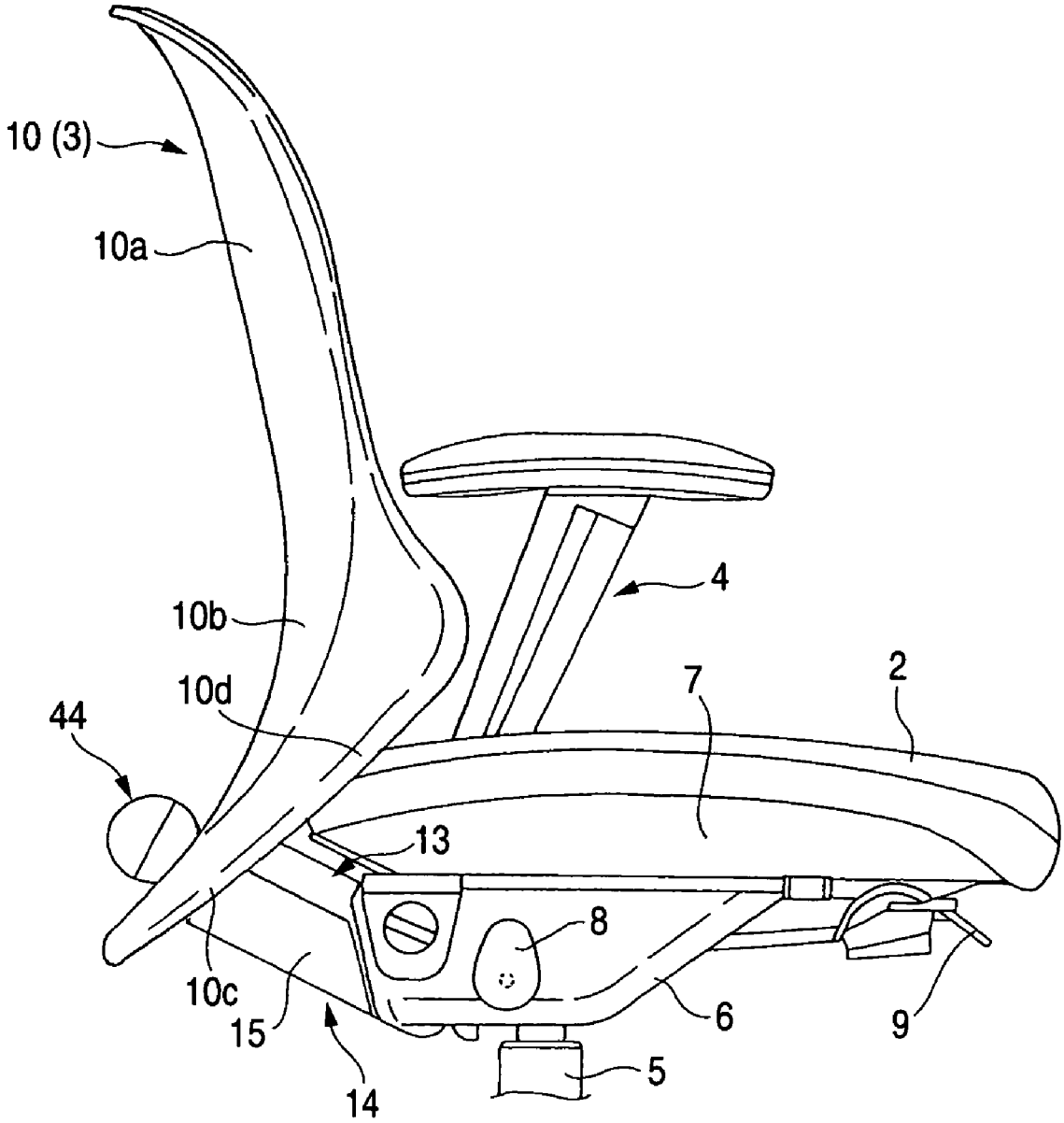
FIG. 2B is a left side view of the chair.

Further, as apparent from FIG. 2A, the right and left sides of the waist rest portion 10*b* are projected further forward than the backrest portion 10*a* and also formed in a gabled shaped which is a forward convex when viewed from the side. The right and left sides of the waist rest portion 10*b* are given a thick-walled portion 10*d* which is much thicker than other portions. The thick-walled portion 10*d* extends down to a part of the lower portion 10*c*.

Figure 4:
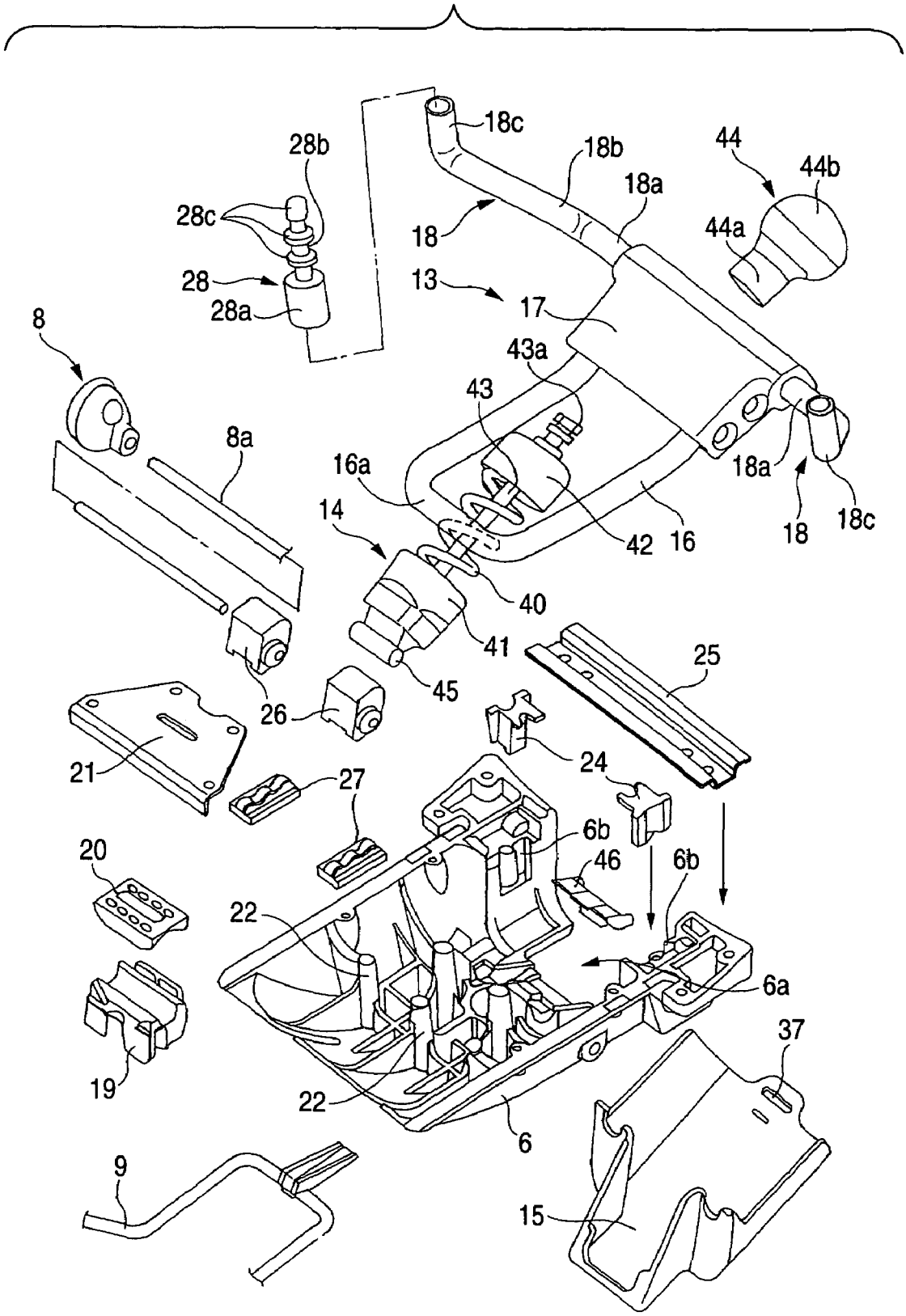
FIG. 4 is a separated perspective view of the member.

A back support unit 13 which is allowed to tilt backward is attached to the base 6, for example, as illustrated in FIG. 4, and to the back support unit 13 is attached a main member 10 of the backrest 3. Further, the back support unit 13 is elastically supported by a spring unit 14. The spring unit 14 is covered by a cover 15 from below. The base 6, the back support unit 13 and the spring unit 14 are major components of the support mechanism unit. Hereinafter, an explanation will be made for the support mechanism and the attachment structure of the backrest 3 by referring to FIG. 6 and subsequent figures.

(2) Support Mechanism of a Seat and Attachment Structure of a Backrest

The base 6 of the present embodiment is a molded article made with a metal such as aluminum die cast or a synthetic resin (as a matter of course, a sheet metal is also acceptable). The seat 2 is structured by applying a cushion to a synthetic resin-made shell-shaped seat board (inner shell), and the seat board is attached to a seat receiving outer shell 7 in a detachable manner, although a detailed explanation of which will be omitted here.

Figure 5:
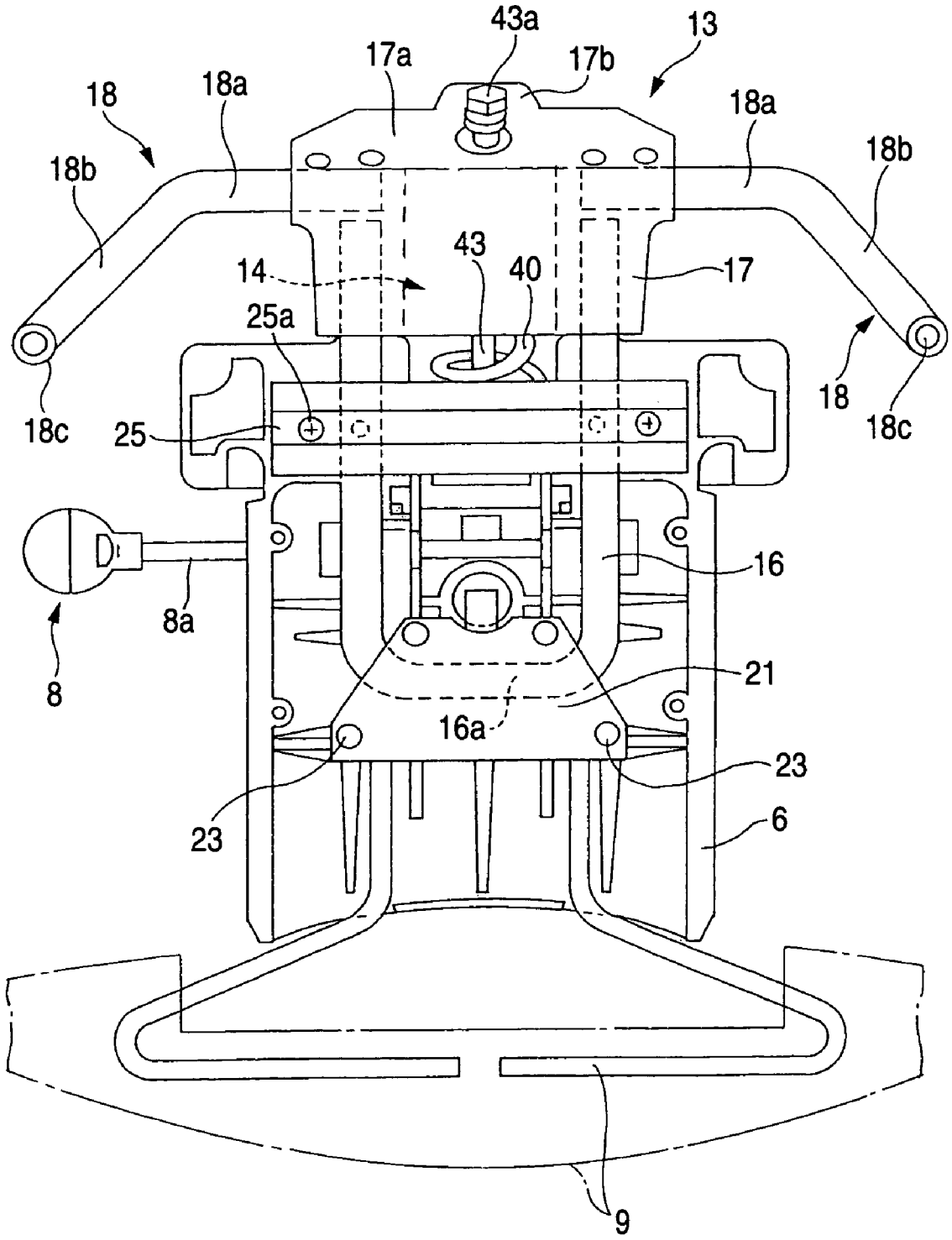
FIG. 5 is a plan view illustrating the chair in a state that the seat is omitted.

As illustrated in FIG. 4 and FIG. 5, the back support unit 13 is provided with a first frame 16 formed in an approximately U-shape when viewed from above by bending a metal round bar, a block-shaped case (housing) 17 firmly welded to a rear end portion of the first frame 16 and a pair of right and left second frames 18 inserted from the sides and fixed to the case 17. A rear end portion of the first frame 16 is inserted into the case 17 and fixed to the case 17 by using screws. Further, the first frame 16 and the second frame 18 may be made with a pipe or a sheet metal and the cross section may be in a rectangular shape and the like.

Figure 6:
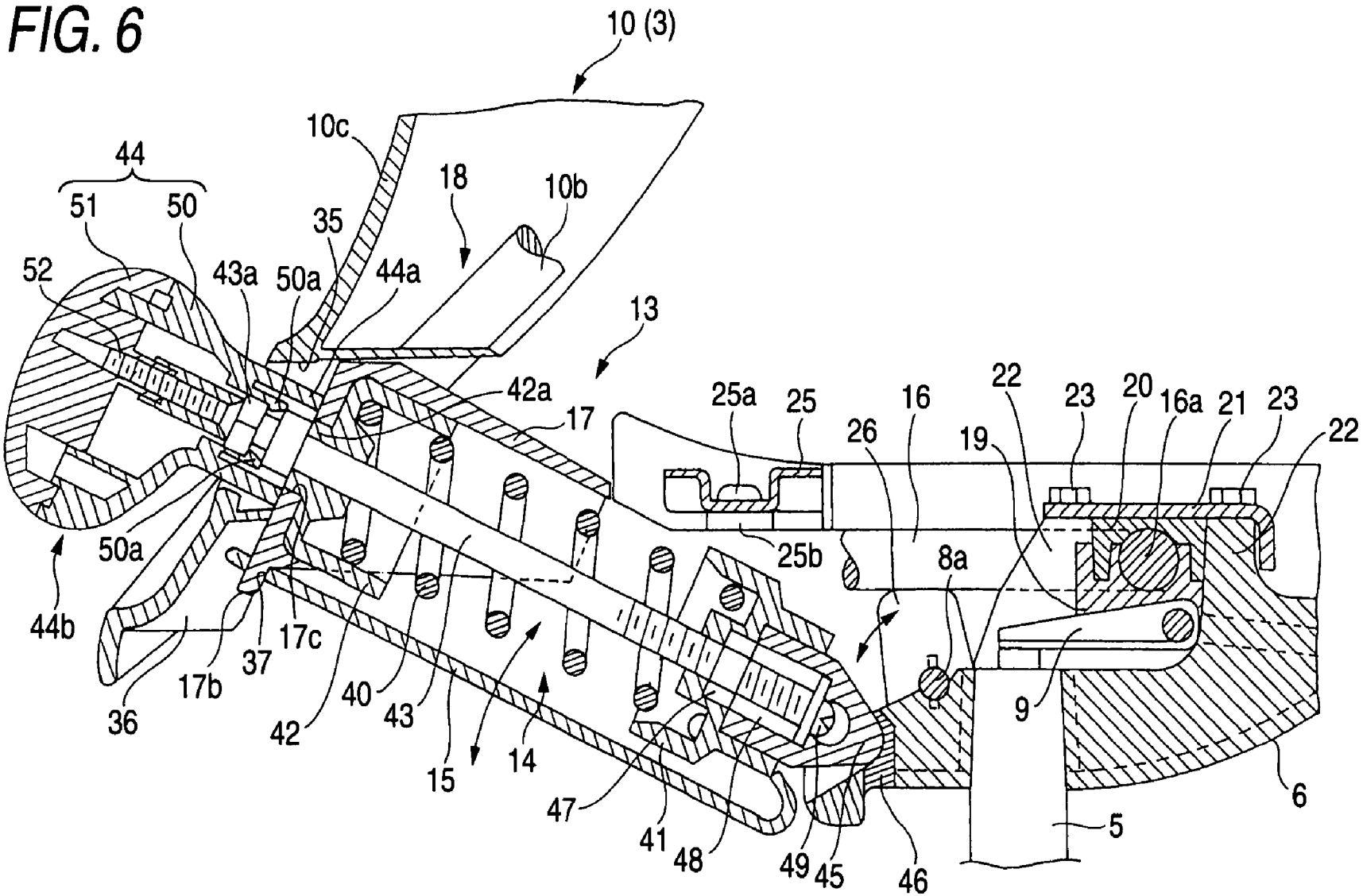
FIG. 6 is a longitudinal cross-sectional view of a support mechanism unit.

The case 17 is, for example, a molded article made with aluminum die cast (it may be made with a synthetic resin or a sheet metal), and provided with the upper surface, the right and left sides and the rear surface so as to open downward as assumed from FIG. 6, for example. The case 17 may be made with a plurality of members.

Of the first frame 16 in the back support unit 13, a front end portion which is longer in a right and left direction is given a spindle portion 16*a*, and the spindle portion 16*a* is attached to the base 6 in a rotatable manner. To be more specific, as illustrated in FIG. 5 and FIG. 6, inside the base 6 are arranged a lower bearing 19 overlapped with the spindle portion 16*a* from below and an upper bearing 20 overlapped therewith from above. These bearings 19 and 20 are kept so as not to be removed by a holding member 21.

The holding member 21 is fixed to an upper surface of a boss portion 22 formed on the base 6 by using screws 23. The upper and lower bearings 19 and 20 are fitted with each other so as not to be removed. Further, in the present embodiment, the lower bearing 19 is provided with functions as a retainer of a lifting lever 9 and as a bearing. Since the bearings 19 and 20 are vertically divided, a first frame 16 in which a spindle portion 16*a* is integrally formed is allowed to be attached to a base 6. Further, the base 6 is opened rearward, by which the first frame 16 is allowed to turn. In addition, a bottom of the base 6 is opened rearward. A symbol 6*a* is given to the rearward opening of the base 6 in FIG. 4 and a front portion of the spring unit 14 enters into an opening 6*a*.

As roughly illustrated in FIG. 4, into an inner surface of right and left wall portions 6*b* constituting a rear portion of the base 6 is inserted and attached a synthetic resin-made guide member 24, both the right and left sides of which are formed long in a vertical direction. The back support unit 13 is held so as not to be deviated to the side by the guide member 24. Also, as illustrated in FIG. 6, the first frame 16 of the back support unit 13 is prevented from turning upward beyond a predetermined range by a stay-shaped stopper 25 which is longer in a right and left direction and fixed to the base 6 by using screws 25*a*. The symbol 25*b* given in FIG. 6 indicates a buffer.

As illustrated in FIG. 4 and FIG. 6, the lock operation lever 8 is fixed to a rotation axis 8*a*, and a pair of right and left rocker cams 26 situated inside the base 6 are attached to the rotation axis 8*a* so as not to relatively rotate. The rocker cam 26 is situated below a longitudinally longer portion of the first frame 16 in the back support unit 13. The lock lever 8 is rotated to change the rocker cam 26 into an upright position and a laterally inclined position, by which the back support unit 13 is switched to a state that it is allowed to tilt backward and a state that it is not allowed to tilt backward. FIG. 6 shows a lock state where no turn is made. For example, as apparent from FIG. 1 and FIG. 2B, the lock lever 8 is formed in an oval shape which extends long in a direction orthogonal to an axial line of the rotation axis 8*a*.

Although a detailed explanation will be omitted, below the right and left rocker cams 26 is arranged a receiving member 27 provided so as not to be deviated on the bottom of the base 6.

Figure 7:
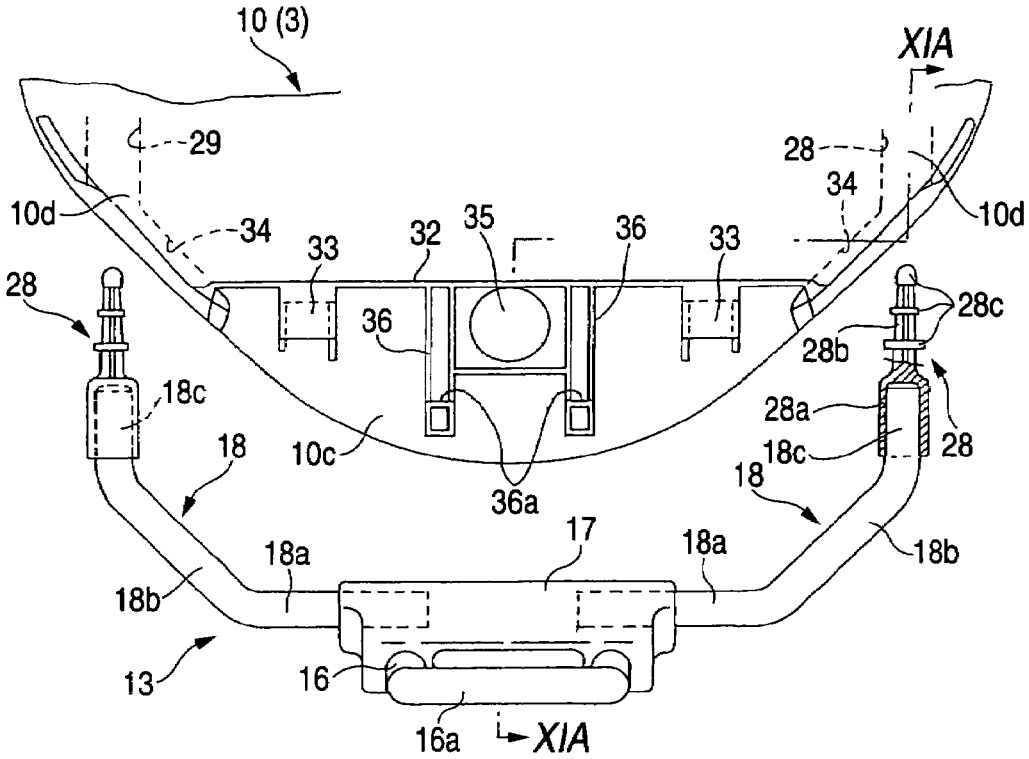
FIG. 7 is a separated front view illustrating a back receiving unit and a backrest.

As illustrated in FIG. 4 and FIG. 7, the second frame 18 of the back support unit 13 is made with a metal round bar and provided with a horizontal axis portion 18*a* extending in a right and left direction, an inclined portion 18*b* extending from an end of the horizontal axis portion 18*a* and a pillar portion 18*c* is erected from an end of the inclined portion 18*b*. The inclined portion 18*b* is inclined so as to fall at the right and left outside when viewed from the front and also inclined forward when viewed from the side. On the other hand, the pillar portion 18*c* extends up to a thick-walled portion 10*d* of the main member 10 in the backrest 3.

Figure 8:
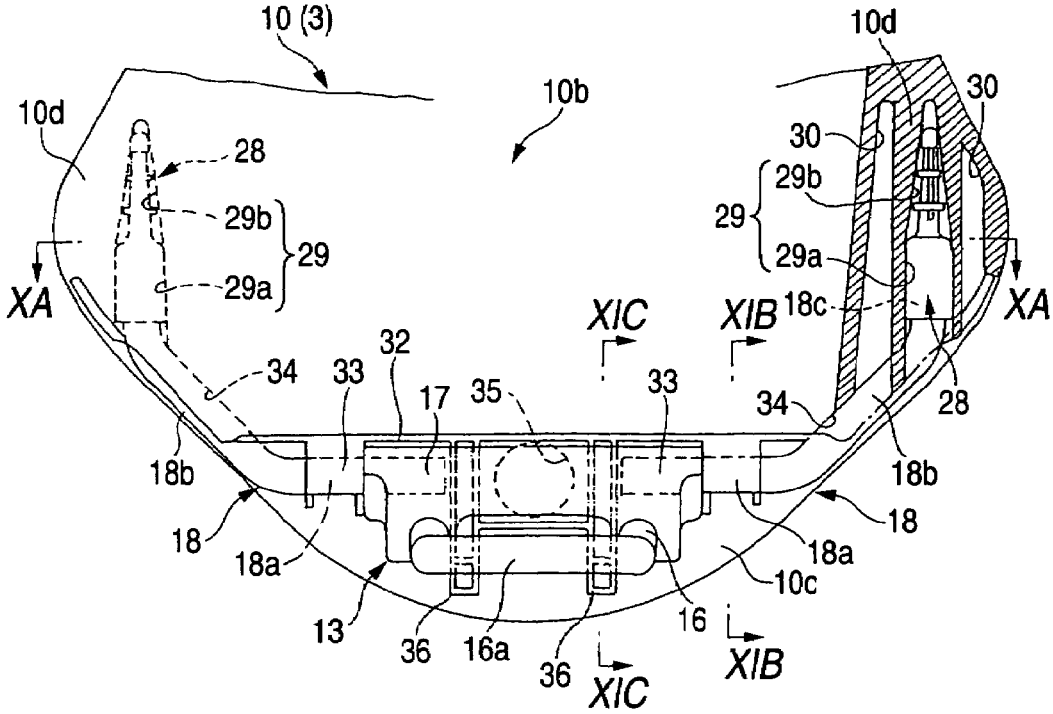
FIG. 8 is a partially broken front view illustrating a state that the backrest is attached to the back receiving unit and also a view indicated by the arrow VIII-VIII in FIG. 10.
Figure 9:
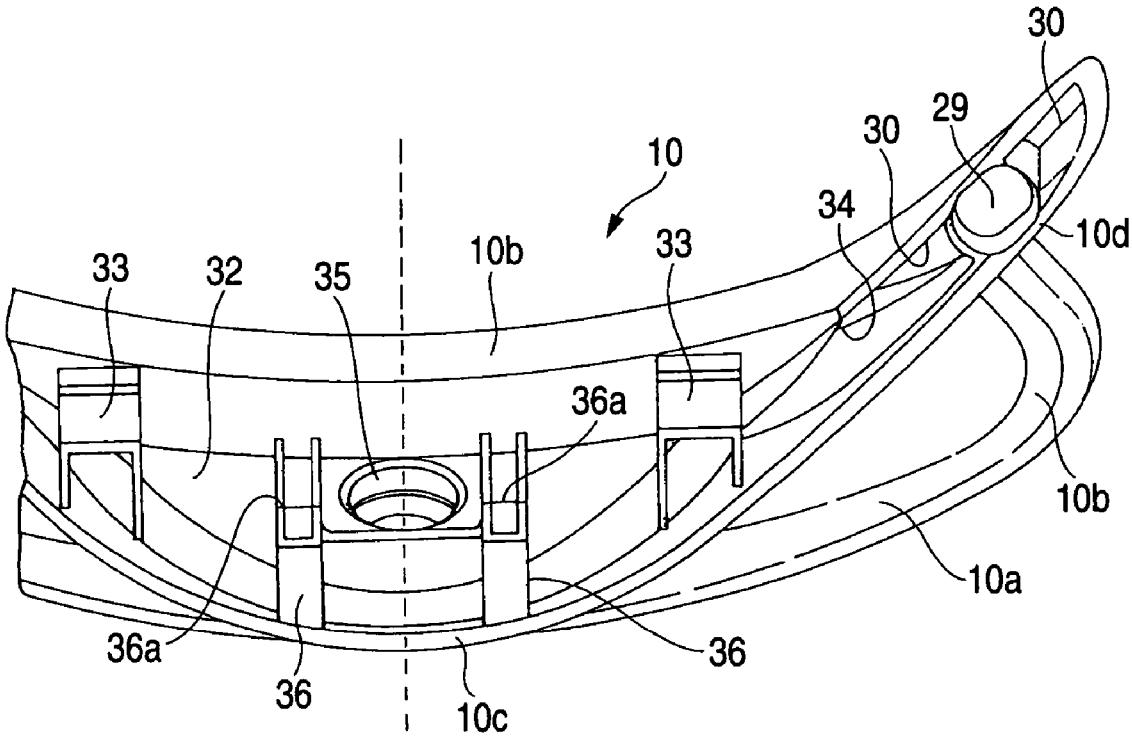
FIG. 9 is a bottom view of the backrest.

Into the pillar portion 18*c* of the second frame 18, a synthetic resin-made pin-shaped buffer 28 is forcibly fitted or fitted by using screws. As shown in FIG. 7 and FIG. 8, a buffer 28 is fitted from below into a fixing hole 29 formed at a thick-walled portion 10*d* of the main member 10 and opened downward. Of main members 10 of backrest 3, a portion having the fixing hole 29 is a fixing portion with respect to the back support unit. In the main member 10, the fixing portion is substantially overlapped with the thick-walled portion 10*d*.

The buffer 28 is provided with a straight cylindrical portion 28*a* fitted into a pillar portion 18*c* of the second frame 18 and a small-diameter tapered axis portion 28*b* which is formed integrally on the upper end thereof. A plurality of annular projections 28*c* are formed integrally at the small-diameter axis portion 28*b*, and a virtual conical surface which is in contact with a group of the straight cylindrical portion 28*a* and an annular projection 28*c* is formed in a tapered shape as a whole. Further, the end of the small-diameter axial portion 28 (or the annular projection 28*c* at the end) is formed in a round shape. On the other hand, the fixing hole 29 of the main member 10 is also provided with a straight portion 29*a* and a tapered portion 29*b*, corresponding to a shape of the buffer 28.

In a neutral state where no person reclines against a backrest 3, pillar portions 18*c* and buffers 28 in the right and left second frames 18 extend in parallel in a vertical direction, when viewed from the front, and at the same time extend in a vertical direction in a state overlapped when viewed from the side. Therefore, when a main member 10 of the backrest 3 is fitted downward into the buffer 28, the main member 10 is guided by the straight cylindrical portion 28*a* of the buffer 28 to move directly below.

A vertical fitting length between a straight cylindrical portion 28*a* of the buffer 28 and a straight portion 29*a* of the fixing hole 29 is greater than an outer diameter of the second frame 18 in the back support unit 13. It is noted that between the fixing hole 29 of the main member 10 and the buffer 28 of the second frame 18 may be provided some clearance for allowing them to relatively move in a back and forth direction or in a right and left direction.

Figure 10A:
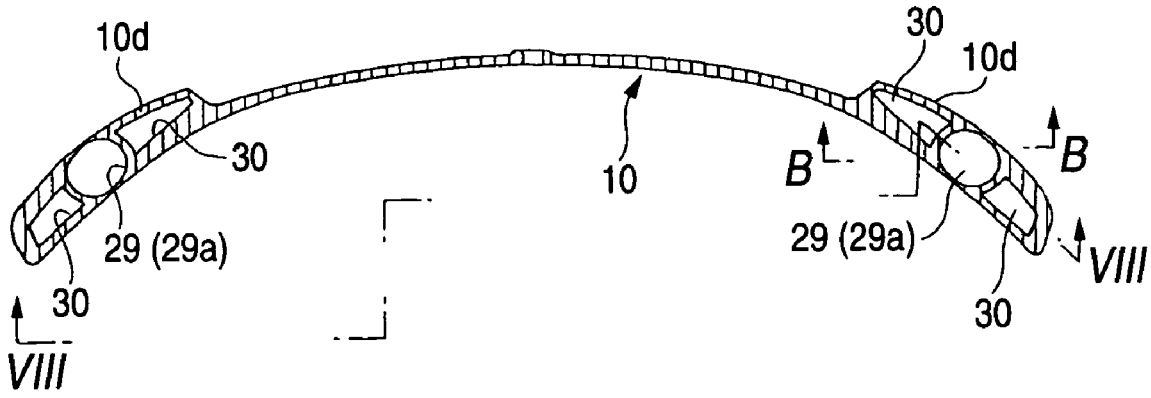
FIG. 10A is a cross-sectional view indicated by the arrow XA-XA in FIG. 8.
Figure 10B:
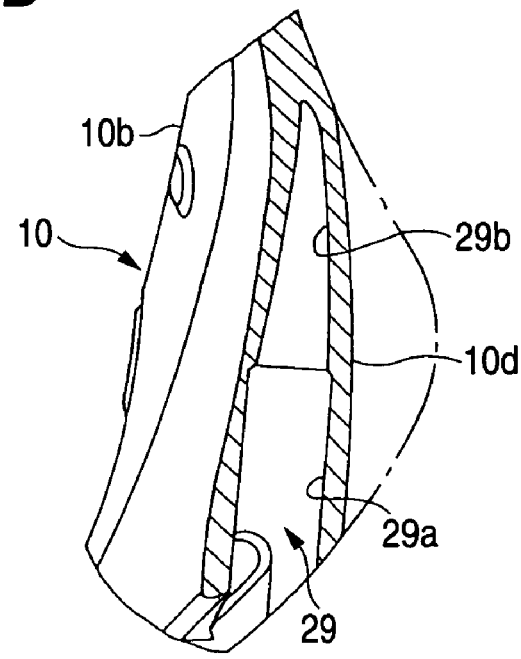
FIG. 10B is across-sectional view indicated by the arrow B-B in FIG. 10A.

As illustrated in FIG. 10A, escape holes 30 opened downward are formed approximately both on the right and left sides which the fixing hole 29 is sandwiched therebetween, when viewed from above, of thick-walled portions 10*d* in the main member 10. The holes are to prevent shrink marks at a thick-walled portion 10*d* on molding or avoid an ununiform stress.

For example, as illustrated in FIG. 3, FIG. 7, FIG. 8 and FIG. 11, a horizontally long rib 32 extending in a right and left direction further above than the lower edge is protruded on a lower front surface of the main member 10. In continuation to the horizontally long rib 32, a catch portion 33 fitted from above into a horizontal axis portion 18*a* of the second frame 18 in the back support unit 13 and opened downward when viewed from the side is formed integrally. A vertical space of the opened edge in the catch portion 33 is slightly smaller than an outer diameter of the second frame 18. Therefore, the catch portion 33 is fitted (engaged) into the horizontal axis portion 18*a* of the second frame by its own elastic deformation.

Figure 3A:
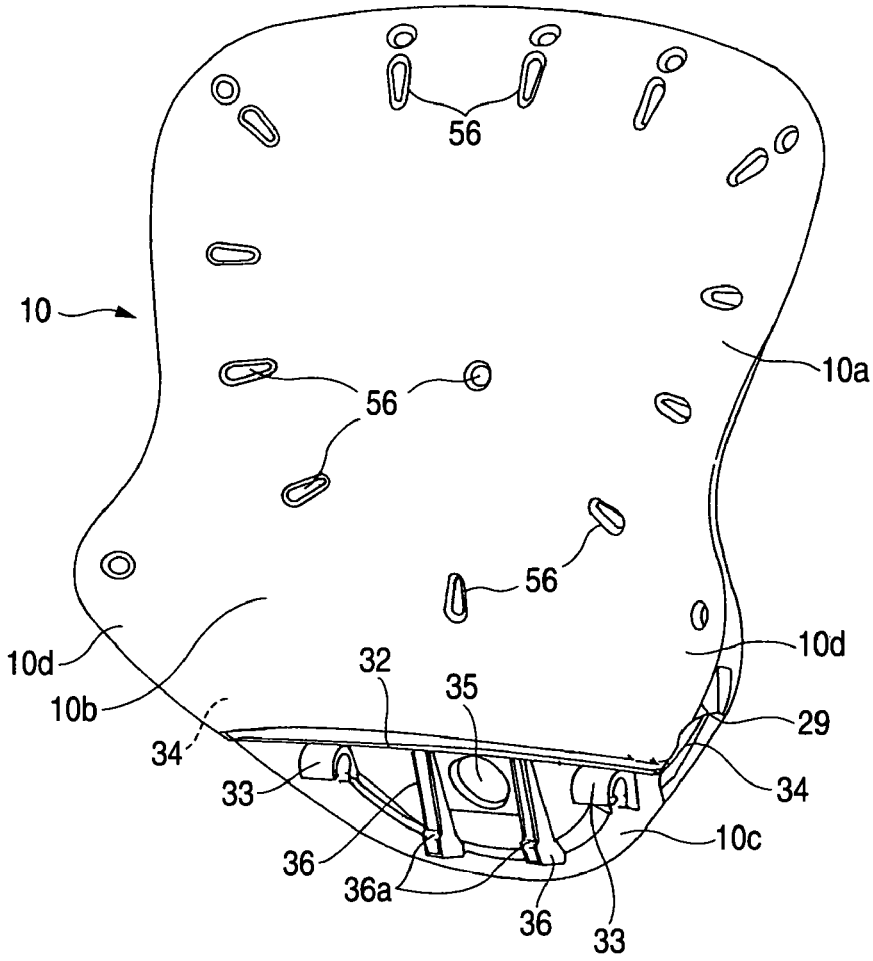
FIG. 3 is a perspective view of a main member constituting a backrest.
Figure 3B:
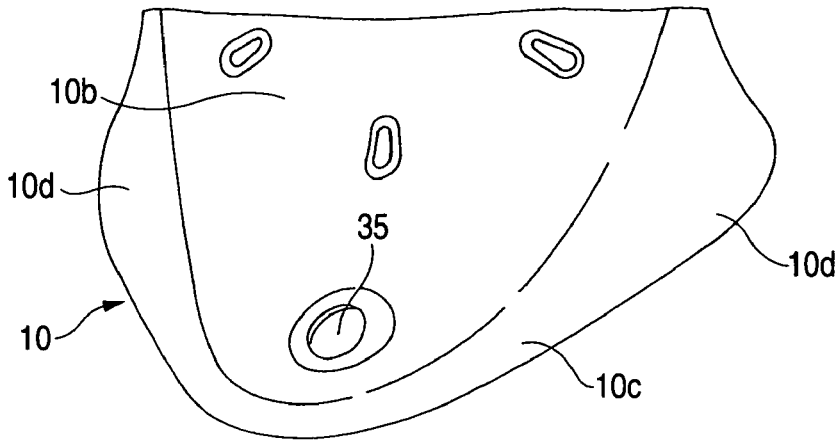

Of the circumference at the lower portion of the main member 10, a part between both ends of the horizontally long rib 32 and the fixing holes 29 are recessed grooves 34 fitted from above into the inclined portions 18*b* of the second frame 18 (refer to FIG. 3, FIG. 7 and FIG. 8). Since the recessed groove 34 is provided, the main member 10 is allowed to be positioned to the second frame 18 of the back support unit 13 in an improved efficiency. Further, since a load resulting from a person who reclines against a backrest 3 acts not only on a pillar portion 18*c* of the second frame 18 but also on the inclined portion 18*b* of the second frame 18, the load acting on the second frame 18 and the main member 10 is dispersed in a wider range, thereby providing advantages such as higher attachment strength and better durability of the main member 10.

For example, as illustrated in FIG. 3, FIG. 6 and FIG. 7, of lower edges of the main member 10, a circular through hole 35 situated intermediate between a right side and a left side of the main member 10 is opened below the horizontally long rib 32. Further, box-shaped vertically-long engagement portions 36 made by a front-facing plate-shaped rib group are protruded both on the right and left sides sandwiching the through hole 35 therebetween. On the other hand, the case 17 of the back support unit 13 is provided with a back plate 17*a* overlapped with the engagement portion 36. A shoulder 36*a* on which the back plate 17*a* of the case 17 in the back support unit 13 is placed, as illustrated in FIG. 11C, is formed at the engagement portion 36. A rear surface of the case 17 is to be overlapped with a front surface of the engagement portion 36.

In a neutral state where no person reclines against a backrest 3, the inclined portion 18*b* of the second frame 18 in the back support unit 13, the rear surface of the case 17 and the front surface of the engagement portion 36 are inclined forward individually at the same angle, when viewed from the side.

On assembly of the main member 10 to the back support unit 13, the right and left buffers 28 in the back support unit 13 may be fitted into the right and left fixing holes 29 and strongly pushed downward. In an initial stage of the fitting procedure, the fixing hole 29 is guided to the buffer 28 due to a tapered shape of the upper part of the buffer 28, by which the fixing hole 29 is smoothly fitted into a tapered portion 28*a* of the buffer 28.

Then, since a fitting length between a straight cylindrical portion 28*a* of the buffer 28 and a straight portion 29*a* of the fixing hole 29 is greater than an outer diameter of the second frame 18 in the back support unit 13, the main member 10 is moved downward, with the position kept accurately, and the catch portion 33 is fitted into a horizontal axis portion 18*a* of the second frame 18.

Then, in a final stage when the catch portion 33 of the main member 10 is fitted into the second frame, a rear lower edge 17*a* of the case 17 is engaged (hooked) with the shoulder 36*a* of the engagement portion 36 by the elastic deformation of the main member 10. Thereby, the main member 10 is fixed to the back support unit 13.

It is noted that in response to the main member 10 moving downward in a vertical direction, the engagement portion 36 of the main member 10 and the rear surface of the case 17 tilt forward, and after the horizontal axis portion 18*a* of the second frame 18 is fitted into the catch portion 33, the rear lower edge of the case 17 comes into contact with the front end of the shoulder 36*a* in the engagement portion 36. Therefore, since the shoulder 36*a* is provided, there is no chance that the catch portion 33 fails in fitting into the horizontal axis portion 18*a*.

When a seated person reclines against a backrest 3, an external force which falls backward acts on a buffer 28 attached to a pillar portion 18*c* of the second frame 18. In the present embodiment, the buffer 28 is in contact with a fixing hole 29 of the main member 10 at four sites, namely, a straight cylindrical portion 28*a* and a three-staged annular projection 28*c*. The present embodiment is advantageous in that the concentrated stress on a certain point of the fixing hole 29 is prevented, thereby improving the supporting strength and durability. The buffer 28 is made with a synthetic resin and undergoes some elastic deformation, which is also helpful in preventing the concentration of stress.

Further, when a seated person reclines against a backrest 3, the main member 10 of the backrest 3 develops a momentum which attempts to tilt backward mainly at a rear lower edge 17*a* of the case 17. However, since the catch portion 33 is situated close to the rear lower edge 17*a* of the case 17 and a small in momentum acting on the catch portion 33, there is no chance that the catch portion 33 is broken. In addition, since a load resulting from rocking motion of the backrest 3 acts in such a way that the engagement portion 36 of the main member 10 is brought into close contact with the case 17, the rocking motion will not cause any disadvantage that the shoulder 36*a* is removed from the case 17.

It is noted that a downward projection 17*b* is formed intermediate between a right side and a left side of the back plate 17*a* in the case 17 constituting the back support unit 13. At the same time, a hole 37 which is fitted into the projection 17*b* is formed on the cover 15 (refer to FIG. 6, FIG. 11 and FIG. 4).

(3) Spring Unit

Next, an explanation will be made for a spring unit 14 by referring mainly to FIG. 4 and FIG. 6.

The spring unit 14 is provided with a compression coil spring 40 as an example of a spring body, a front spring bearing 41 for receiving the compression coil spring 40 from the front, a rear spring bearing 42 for receiving the compression coil spring 40 from behind, an adjusting rod (adjusting bolt) 43 fitted between the front spring bearing 41 and the rear spring bearing 42, an operation handle 44 fitted into the adjusting rod 43 from behind so as not to relatively rotate and an axis supporting member 45 fitted into the front spring bearing 41 from the front.

The axis supporting member 45 is supported via the synthetic resin-made receiving member 46 by the rear end portion of the base 6. Since a contact surface between the axis supporting member 45 and the receiving member 46 is formed in an arc shape when viewed from the side cross section, the axis supporting member 45 is allowed to turn and is also kept so as not to be removed vertically. Although not illustrated, a portion at which the axis supporting member 45 is fitted into the front spring bearing 41 is rectangular when viewed from the cross section (non-circular), and the front spring bearing 41 is therefore kept so as not to be rotated, and also the front spring bearing 41 is fitted into the axis supporting member 45 so as to slide back and forth.

On the other hand, at the rear end of the rear spring bearing 42 is formed a small-diameter cylindrical boss portion 42*a*. The boss portion 42*a* is fitted into a hole 17*c* formed on a back plate 17*a* of the case 17 in the back support unit 13 so as not to be deviated. Further, an adjusting rod 43 is fitted into the boss portion 42*a* of the rear spring bearing 42 and a head 43*a* of the adjusting rod 43 is exposed behind the case 17.

A nut 47 is embedded into the front spring bearing 41 so as not to be rotated, and an adjusting rod 43 is screwed into the nut 47. Further, a spacer 48 is fitted into a front end portion of the adjusting rod 43 and the spacer 48 is inserted into the axis supporting member 45. A washer is fixed to a front end surface of the adjusting rod 43 by using screws 49.

A head 43*a* of the adjusting rod 43 is formed in a non-circular shape such as a hexagonal shape, and a boss portion 44*a* of an operation handle 44 is fitted to the head 43*a*. The operation handle 44 is constructed by two resin-made front and rear members 50 and 51 fixed with screws 52, and the front member 50 is provided with a click 50*a* which is engaged with or removed from the head 43*a* of the adjusting rod 43 by an elastic deformation. Therefore, the operation handle 44 is allowed to be attached to or detached from the adjusting rod 43 by using the elastic deformation of the click 50*a*. It is noted that the operation handle 44 is attached to the adjusting rod 43 by the use of screws, pins and the like. However, in this respect, the present embodiment is advantageous in that such attachment and detachment are performed by a simple and quick action.

As illustrated in FIG. 6, a boss portion 44*a* of the operation handle 44 is loosely fitted into a through hole 35 of the main member 10.

In the present embodiment, a grip portion 44*b* of the operation handle 44 is formed roughly in an oval shape which is longer in a direction orthogonal to an axial line of the adjusting rod 43 (extending approximately in a vertical direction as illustrated in FIG. 6), while being formed in a round shape as a whole. At a portion deviated to one end along the longitudinal direction is formed a boss portion 44*a*. Since the grip portion 44*b* is formed in an oval shape, a person is able to use the grip portion without any burden on the palm of the hand and smoothly rotate the grip portion in the palm of the hand. Further, the boss portion 44*a* is deviated toward one end of the grip portion 44*b* to provide a greater momentum on rotation, thereby making it possible to operate the grip portion by a slight force.

FIG. 6 shows a state closer to that in which an initial elastic force of the compression coil spring 40 is the weakest. When the operation handle 44 is operated to pull the front spring bearing 41 in this state, the initial elastic force is made greater. Further, the state in which the initial elastic force of the compression coil spring 40 is the weakest, a spacer 48 acts as a stopper to prevent the front spring bearing 41 from moving forward.

Since the boss portion 44*a* of the operation handle 44 is fitted into a through hole 35 of the main member 10, there will be no chance that the backrest 3 is removed from the back support unit 13, even if the engagement portion 36 is removed from the case 17 (therefore, the operation handle 44 acts as a safety device). It is noted that the boss portion 44*a* of the operation handle 44 is not arranged in the through hole 35 (in this instance, the operation handle 44 is exposed entirely behind the main member 10), but other members through which the adjusting rod 43 passes may be arranged in the through hole 35 to act as a safety device.

(4) Summary

When a seated person reclines against a backrest 3, a rear spring bearing 42 is pushed forward due to a difference in the tilt supporting point between a back support unit 13 and a spring unit 14, by which the backrest 3 will tilt backward while compressing and deforming a compression coil spring 40. In association with the backward tilt of the backrest 3, the spring unit 14 also tilts backward, and the rear spring bearing 42 also slides relatively with an adjusting rod 43. Then, since the compression coil spring 40 is arranged behind a base 6, the compression coil spring 40 can be made longer in length.

Moreover, the backward tilt of the backrest 3 will increase both the load acting on a spring (momentum) and elastic restoring force of the spring. In this instance, when an increasing rate of the load is in accordance with that of the elastic restoring force, a reaction force against the body of a person is made uniform over a whole range of the backward tilt, thereby providing a comfortable rocking motion.

However, when a spring is expanded or contracted to a small extent, an increasing rate of momentum tends to be apart from that of elastic restoring force, resulting in a fact that the spring is so weak in force that it tilts backward abruptly or, in a reverse case, the spring is so strong in force that it does not tilt backward completely. Therefore, it is difficult to obtain a certain reaction force over a whole range of the backward tilt (or it is difficult to make adjustment).

However, in the present embodiment, since a compression coil spring 40 can be made greater in expansion and contraction stroke, it is easy to adjust an increasing rate of the elastic restoring force closer to that of the load. Further, since a turnable supporting point (16*a*) of a back support unit 13 is situated further forward than a front end of a spring unit 14, a portion distant from a tilt supporting point in the back support unit 13 is able to support the point by using the spring unit 14 (namely, the supporting span can be made longer than conventionally). Therefore, it is possible to prevent excessive momentum acting on the spring unit 14, which is also helpful in realizing a slow backward tilt of the backrest 3.

In addition, a rocking chair may have a phenomenon that when the chair is rocked, a slippage is found between the back of a seated person and a backrest due to separation of the backrest from a seat (shirt riding-up phenomenon or back slippage phenomenon). However, in the present embodiment, since a turnable supporting point (16*a*) of the back support unit 13 is situated further above and also further forward than an ordinary chair, a seat 2 separates from a backrest 3 to a smaller extent in a rocking motion, thereby making it possible to remarkably reduce the shirt riding-up phenomenon or the slippage phenomenon, which is advantageous.

In the chair of the present embodiment, a support mechanism unit is constructed with major components such as a base 6, a back support unit 13 and a spring unit 14. Then, the back support unit 13, the spring unit 14 and the base 6 constitute a kind of link mechanism, and the back support unit 13 is also prevented by a stopper 25 from turning upward beyond a predetermined range. Therefore, the support mechanism unit is allowed to be transported or stored independently, which will improve the assembly work efficiency, when applied to chairs assembled by a knock-down method.

Further, the backrest 3 is attached by a simple and quick work that a main member 10 is fitted into a second frame 18 of a back support unit 13 from above, thereby making it possible to attach the backrest 3 efficiently, which is a great advantage of the present invention.

As illustrated in FIG. 3A, the main member 10 of the backrest 3 is provided with a group of engaging holes 56 opened in a back and forth direction as a means for attaching cushions 11 and 12. Although a detailed explanation will be omitted, the cushions 11 and 12 are attached to a synthetic resin-made inner shell via a cover material, and the inner shell is provided with a click which is attached to or detached from the engaging holes 56 due to elastic deformation. Since a front surface of the main member 10 is smooth, there may be a use mode where the cushions 10 and 11 are not attached. Further, where cushions are provided, they may be provided separately, without division into an upper cushion and a lower cushion. However, in the present embodiment where the cushions are divided into an upper cushion and a lower cushion, there is an advantage to improve the design properties, for example, by using the upper and lower cushions 10 and 11 different in color and quality of material.

A front end of the spring unit 14 may be connected to the base 6 by using pins. However, as described in the present embodiment, a receiving member 46, which is forward recessed when viewed from the side, is used to support an axis supporting member 45, thereby making it possible to simplify the assembly of a support mechanism unit, which is also advantageous. More specifically, in the present embodiment, the back support unit 13 is at first attached to the base 6, and a front end of the spring unit 14 is then brought into contact with the receiving member 46. While the above state is kept, the back support unit 13 is pushed down until the first frame 16 is inserted inside the base 6, and the stopper 25 is then fixed to the base 6 by using screws 25*a* (refer to FIG. 6). Through the procedures described above, the back support unit 13 and the spring unit 14 are undetachably attached to the base 6. As explained above, a simple assembly of the support mechanism unit is a great advantage in the present embodiment.

(5) Second Embodiment

FIG. 12 and FIG. 13 shows a second embodiment. In the second embodiment, a catch portion 33 of a main member 10 in a backrest 3 is opened forward. Further, although a whole picture is not given in the drawing, the second embodiment is provided with a back support unit 13 similar to that provided in the first embodiment.

Then, in the embodiment, on attaching the backrest 3 to the back support unit 13, a main member 10 is fitted completely into a pillar portion 18*c* of a second frame 18 by utilizing elastic deformation of the second frame 18 of the back support unit 13 and the main member 10, and then an horizontal axis portion 18*a* of the second frame 18, the main member 10, and the catch portion 33 are fitted together.

(6) Other

The present invention may be available in various modes, in addition to the above-described embodiments. For example, a configuration of the back receiving unit and that of the base may be modified in any way according to the requirements such as design.

Further, the present invention is applicable to synchro-structured chairs in which a seat moves backward or tilts backward in association with backward tilt of a backrest. The present invention is also applicable to fixed type chairs, for example, chairs for theaters and those for vehicles.

What is claimed is:

1. A chair comprising:

a seat;

a base, wherein said base supports said seat from below;

a backrest, wherein said backrest is attached to said base by a back support unit that allows said backrest to tilt backward to provide a backward tilt; and a spring means, wherein said spring means elastically supports said backward tilt of said back support unit and said backrest;

wherein said spring means expands and contracts in a back and forth direction when viewed from above;

wherein said spring means is supported by a forward portion of said base, and wherein said spring means activates when a rearward load is applied from said backward tilt of said backrest;

wherein a rear end portion of said spring means is situated further rearward than a tilt supporting point of said back support unit;

wherein said rear end portion of said spring means extends through said backrest;

wherein a front end portion of said spring means is situated further below than said tilt supporting point of said back support unit; and wherein said spring means is allowed to tilt together with said backrest and said back support unit centering around a support portion in relation to said base.

2. The chair as set forth in claim 1, wherein:

said back support unit and said backrest are manufactured separately;

a plurality of pillar portions extending approximately upward are arranged on the right and left sides at a rear portion of said back support unit with a predetermined space when viewed from the front; and a fixing portion having a fixing hole opened downward and fitted into said pillar portions from above is formed on said backrest.

3. The chair as set forth in claim 1, wherein:

said backrest comprises a synthetic resin-made main member in which a portion of said main member that supports the body of a seated person is continuously and integrally formed with a portion attached to said back support unit; and said main member extends downward beyond a seat surface to form a fixing portion which fits from above into said pillar portion of said back support unit.

4. The chair as set forth in claim 3, wherein:

said back support unit comprises:

a first frame extending in a back and forth direction, wherein a front end portion of said first frame is attached to said base; and a second frame made of a metal bar or a metal pipe, wherein said second frame projects on both right and left sides behind said first frame;

said second frame is provided with an inclined portion which falls on the right and left outside when viewed from the front and an upward pillar portion mounted at a front end of said inclined portion;

said fixing portion of said backrest is fitted from above into said pillar portion; and a recessed groove which fits from above into said inclined portion of said second frame in said back support unit is formed on said main member of said backrest.

5. The chair as set forth in claim 4, wherein:

a synthetic resin-made pin-shaped buffer extending upward from a upper end of said pillar portion is attached to a pillar portion of said back support unit and said pin-shaped buffer is fitted into said fixing hole of said main member in said backrest.

6. The chair as set forth in claim 4, wherein:

a catch portion is formed in said main member of said backrest, wherein said catch portion is elastically fitted into a horizontal axis portion of said second frame.

7. The chair as set forth in claim 1, wherein:

said spring means comprises a compression coil spring and assembled into a spring unit;

said spring unit is provided with:

a front spring bearing which supports the compression coil spring from the front;

a rear spring bearing which receives the compression coil spring from behind;

a screw-type adjusting rod which adjusts a space between said front spring bear and said rear spring bearing; and an operation handle, wherein said operation handle rotates and operates said adjusting rod from behind said rear spring bearing to adjust said space between said front spring bearing and said rear spring bearing; and a rear end portion of said adjusting rod is exposed behind said rear spring bearing, thereby allowing said adjusting rod to be rotated by said operation handle.

8. The chair as set forth in claim 7, wherein:

said backrest and the said back support unit are manufactured separately;

said backrest comprises a synthetic resin-made main member in which a portion of said main member that supports the body of a seated person is continuously and integrally formed with a portion attached to said back support unit;

a lower portion of said main member is overlapped with said back support unit when viewed from behind;

a back plate which receives said rear spring bearing from behind is formed at the rear end of said back support unit;

said adjusting rod of said spring unit is exposed backward from said back plate; and a hole for allowing said operation handle to attach to or detach from said adjusting rod is formed at a site overlapping with said back plate of said back support unit in a main portion of said backrest.

9. The chair as set forth in claim 8, wherein:

said operation handle is provided with:

a boss portion fitted into said adjusting rod so as not to relatively rotate; and a grip portion integrally formed at a rear end of said boss portion; and said boss portion is fitted into a hole of said main member in said backrest and said grip portion is formed in an oval shape.

10. A support mechanism unit of a chair, comprising:

a base, supporting a seat from behind;

a back support unit, attached so as to tilt backward to said base for attaching a backrest;

a spring unit, which elastically supports the backward tilt of said back support unit; said spring unit being provided with:

a compression coil spring arranged in a posture extending in a back and forth direction when viewed from above and in a backward tilted posture when viewed from the side;

a front spring bearing for receiving said compression coil spring from the front;

a rear spring bearing for receiving said compression coil spring from behind; and a screw-type adjusting rod for adjusting a space between said front spring bearing and said rear spring bearing;

wherein said adjusting rod extends coaxially with the axis of said compression coil spring and a rear end of said adjusting rod is exposed behind said rear spring bearing and an operation handle is attached to the exposed portion;

a turnable supporting point of said back support unit is situated further upward and forward than a front end of said spring unit;

a support portion of said rear spring bearing is formed at the rear portion of said back support unit, a front end portion of said spring unit is supported by said base in a non-fixed manner so that said spring unit is allowed to tilt backward together with said back support unit;

a stopper which restricts an upward turning position of said back support unit is fixed to said base; and an initial elastic force is imparted to said compression coil spring in a state that said back support unit is held by said stopper so as not to be turned upward.

* * * * *